United States Patent [19]

Ogawa

[11] 4,311,901

[45] Jan. 19, 1982

[54] CASH REGISTER MECHANISM

[75] Inventor: Mikio Ogawa, Masashino, Japan

[73] Assignee: Western Stamping Corporation, Jackson, Mich.

[21] Appl. No.: 102,396

[22] Filed: Dec. 11, 1979

[51] Int. Cl.[3] ..... G06C 27/00

[52] U.S. Cl. ..... 235/12; 235/1 E

[58] Field of Search ..... 235/1 E, 12–16, 235/25, 7 R; 46/2

[56] References Cited

U.S. PATENT DOCUMENTS

| | | | |
|---|---|---|---|
| 1,906,361 | 5/1933 | Berry | 235/1 E |
| 2,458,850 | 1/1949 | Hardick | 235/12 |
| 2,458,863 | 1/1949 | Kroenlein | 235/12 |
| 3,957,198 | 5/1976 | Thomson | 235/1 E |
| 4,025,756 | 5/1977 | Thomson | 235/1 E |
| 4,093,848 | 6/1978 | Thomson | 235/1 E |

*Primary Examiner*—L. T. Hix
*Assistant Examiner*—Benjamin R. Fuller
*Attorney, Agent, or Firm*—Harness, Dickey & Pierce

[57] ABSTRACT

A cash register mechanism has targets swingable up and down between a lowered concealed horizontal retracted position and a raised visible position close to and behind a window by means of pushrods actuated by key levers. The pushrods have latchable keeper lugs which when the pushrods move up, bear laterally against a flange on a pivoted latch plate, and move to a position above the flange where the flange can underlie the keeper lugs to maintain the pushrods and targets raised. The latch plate is spring biased toward latching position. The keeper lugs tend to cam the latch plate toward the released position and bow the pushrods in the opposite direction. The latch plate is pivoted at the bottom and the flange inclines upwardly and laterally therefrom toward the pushrods. The pushrods are relatively flexible. When a keeper lug overlies the flange, spring biases oppose releasing movement of the latch plate, permitting additional targets to be raised without camming the latch plate to released position.

The targets, pushrods and their supporting means are formed as an integral plastic molding.

The targets are releasable to return to retracted position by a release cam engageable with the latch plate carried by a stiffer pushrod actuatable by a target release lever.

11 Claims, 23 Drawing Figures

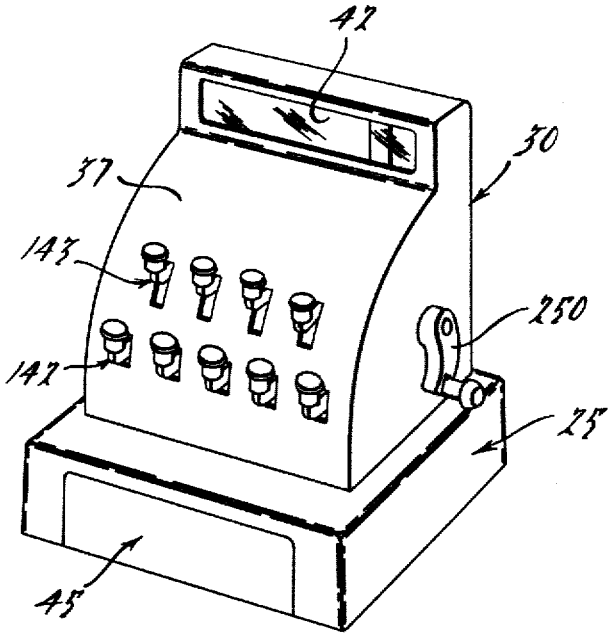
FIG. 1.
FIG. 3.
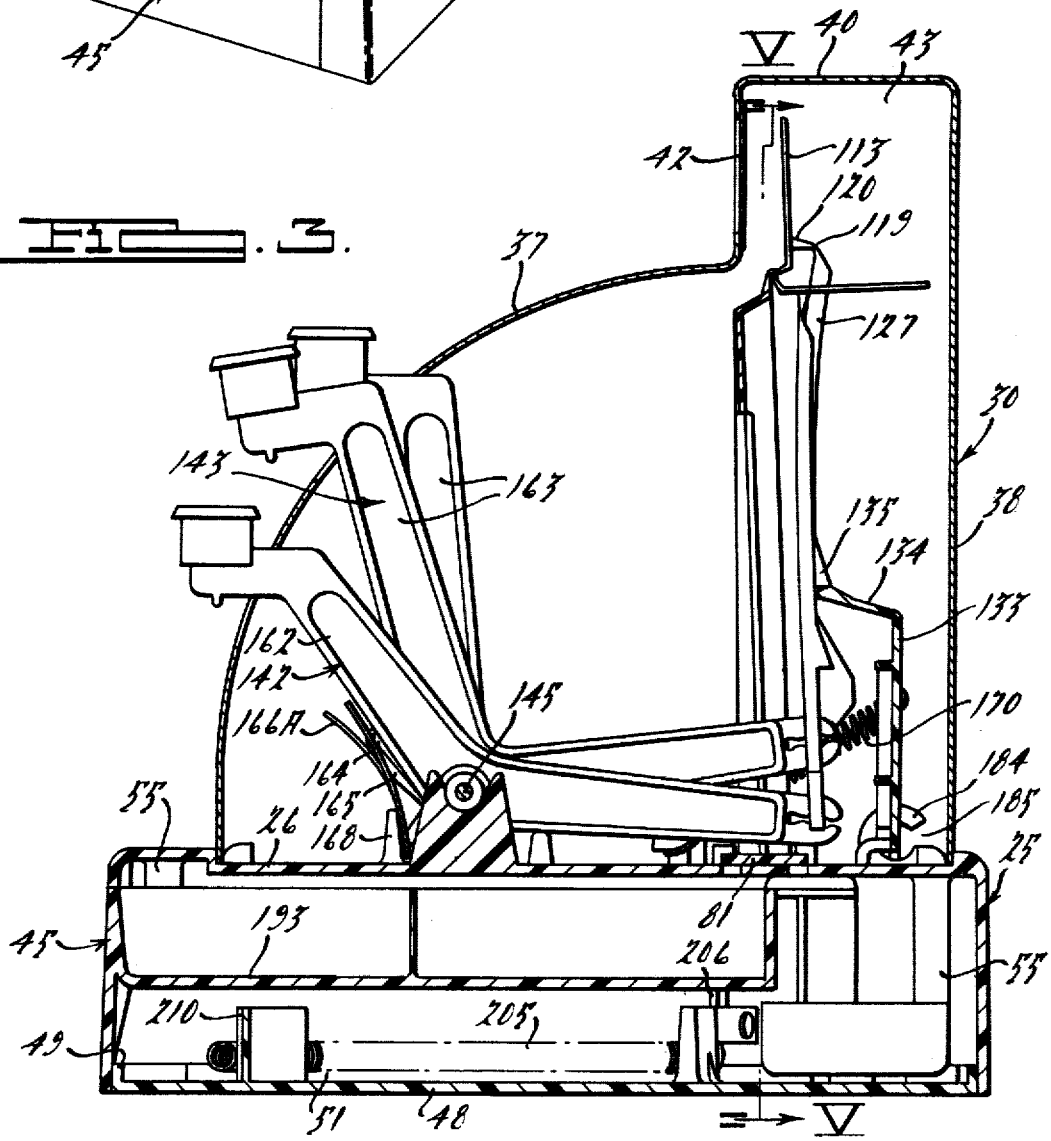

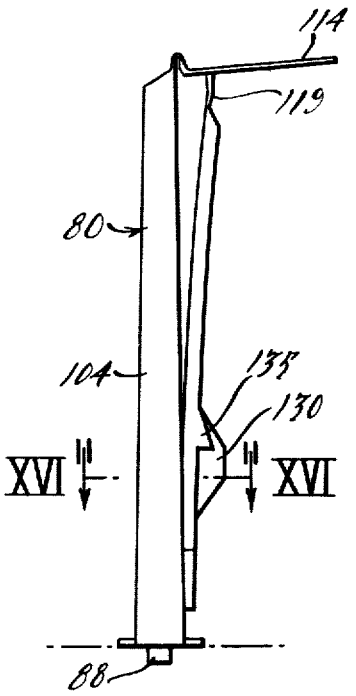
FIG. 15.
FIG. 19.
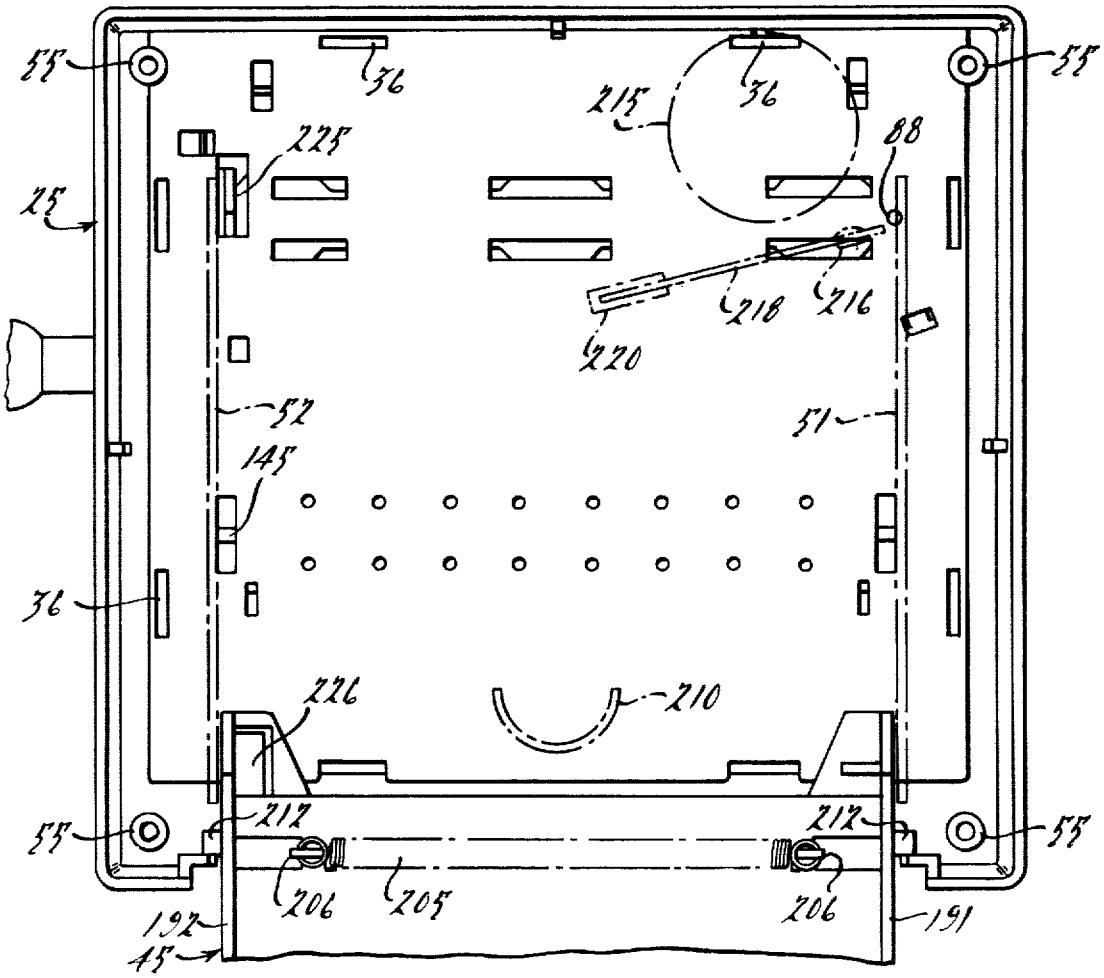

CASH REGISTER MECHANISM

BACKGROUND OF THE INVENTION

This invention is concerned with improving and lowering the cost of toy cash registers. An important object of the invention is to provide an improved and simplified target assembly, target supporting, target actuating and target latching means wherein a plurality of the parts are formed as a unitary plastic molding and the latching means permits successive targets to be raised and latched in raised position until all are intentionally released, and such successive latching is achieved without the necessity of providing additional parts and with an actual reduction in the cost of the cash register as compared with previously known units capable of comparable performance.

Other objects and advantages will become apparent to persons skilled in the art upon consideration of the present disclosure in its entirety.

BRIEF DESCRIPTION OF THE FIGURES OF DRAWING

FIG. 1 is a perspective view of a toy cash register incorporating the principles of the present invention;

FIG. 3 is a cross section taken substantially on the line III—III in FIG. 2 and looking in the direction of the arrows;

FIG. 15 is a side elevational view in the direction indicated by the arrow XV in FIG. 13, but with the parts folded to the relative positioning they occupy in the cash register;

FIG. 19 is a bottom plan view of the cash register with the base plate removed, showing the drawer projected and partly broken away;

DETAILED DESCRIPTION OF THE FIGURES OF DRAWING

Figure 2:
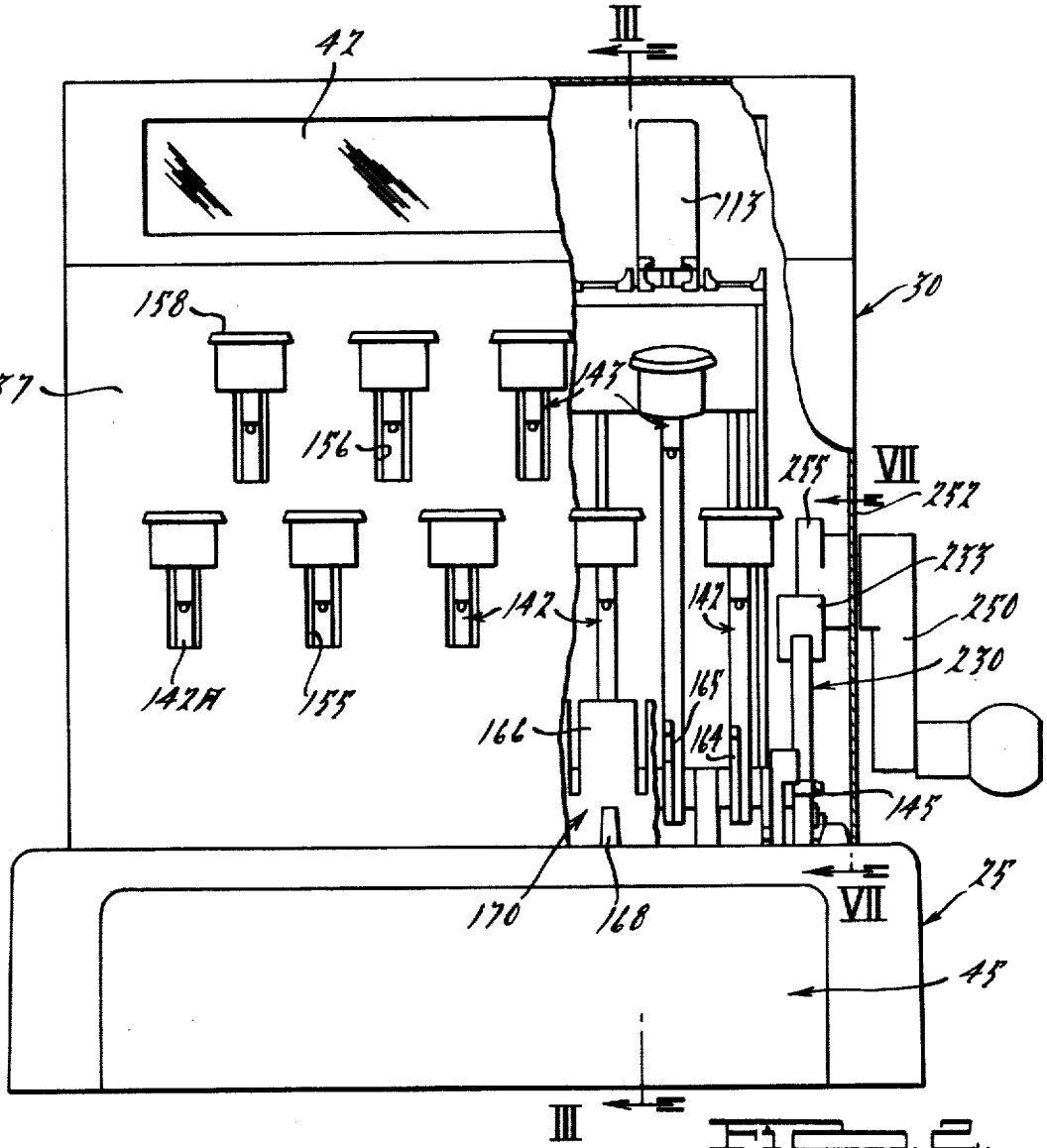
FIG. 2 is a front elevational view, partly broken away.
Figure 7:
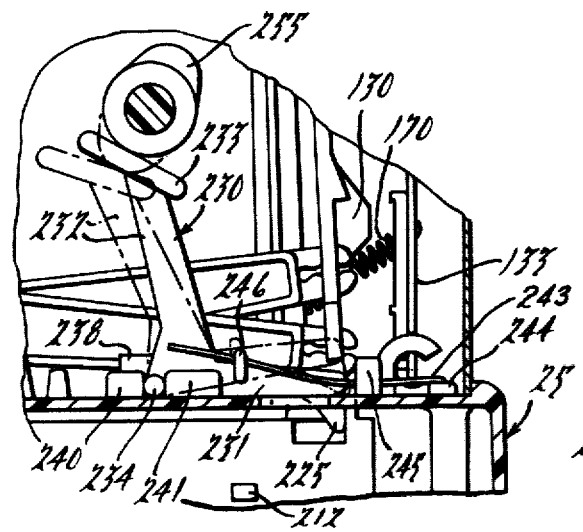
FIG. 7 is a sectional detailed view taken substantially on the line VII—VII in FIG. 2 and looking in the direction of the arrows.

The principal support for the machine comprises a base member generally designated 25 of inverted box-like form. A flat slightly depressed rectangular flat panel area 26 which constitutes the principal portion of the top wall of the base 25 is provided with upstanding locating portions, hereinafter to be considered in detail, for the several components of the mechanism, these and the entire base being integrally molded from a suitable plastic.

Integral locating lugs 31, 32, 33, 34, are provided, upstanding from the panel area 26 midway of the length of each side of the panel area and located close to the shoulder 28 formed by the depressed positioning of the panel area. An upper housing generally designated 30 and which is preferably formed of sheet metal (metal having been preferred primarily because it permits of attractive lithographed ornamentation) is open at the bottom and of a rectangular shape and size such that its lower margins will fit snugly within the rectangular border of panel area 26 between lugs 30–34 and the shoulder 28 defined by the depression of panel area 26. The upper housing has conventional integral tongues projected through slots 36 in the panel area and bent over therebeneath to secure the upper housing to the base. As shown in FIGS. 1 and 3, the upper housing 30 is of a conventional shape having a partly cylindrical front keyboard section 37, a flat back wall 38, and an upstanding target viewing enclosure area 40 with a transparent front window 42 through which the raised targets are viewed.

A cash drawer generally designated 45 is slidable inwardly and outwardly of the base 25 in a conventional manner through the front opening 46 of the base and is retained in position by a bottom closure defined by a base plate 48. Base plate 48 has longitudinally extending upstanding guide ribs 51, 52 between which the drawer is slidably guided. The base plate is secured to the base 25 by conventional screws 50 projected through reinforced holes 54 into screw receiving bosses 55 extending downwardly from the top inner wall of base 25.

Figure 8:
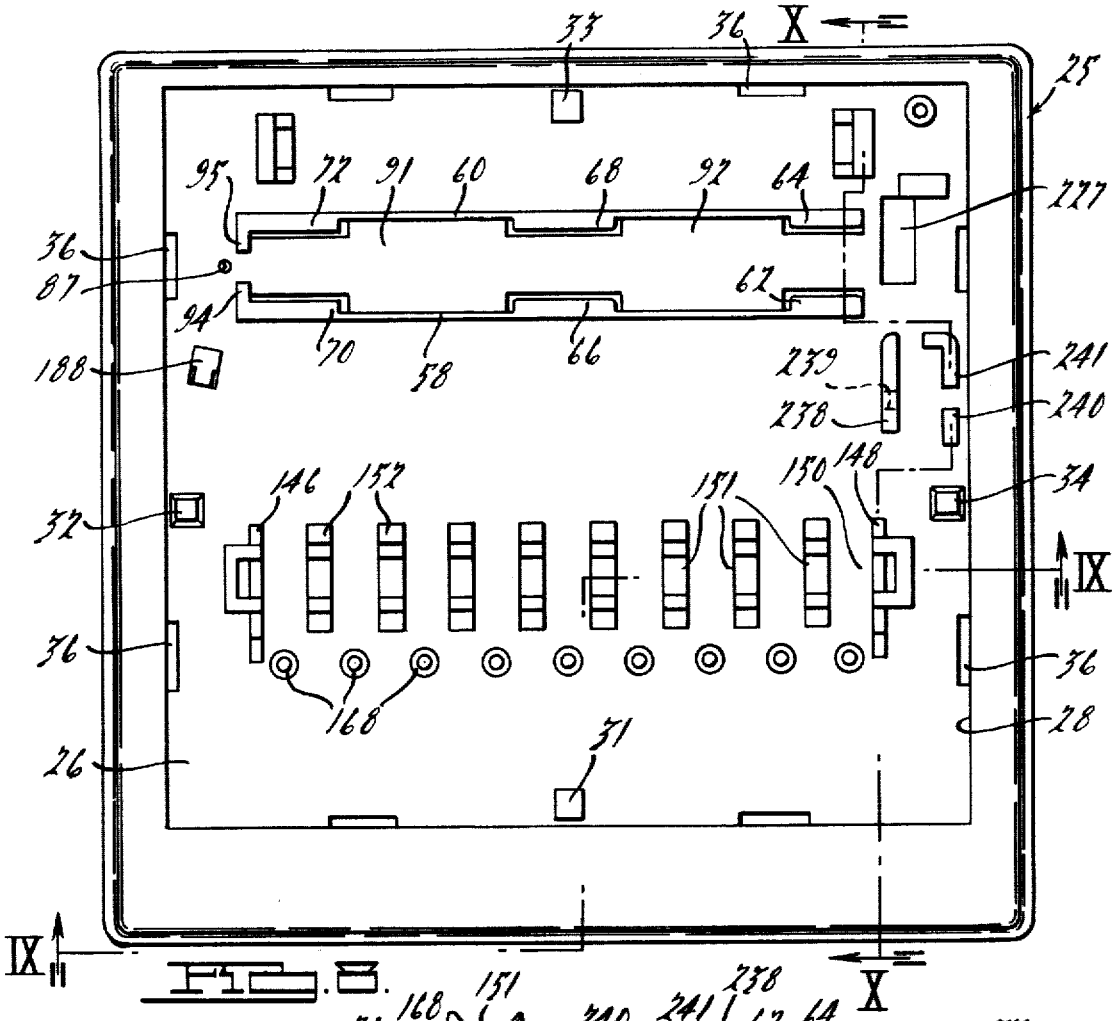
FIG. 8 is a top plan view of the base.
Figure 10:
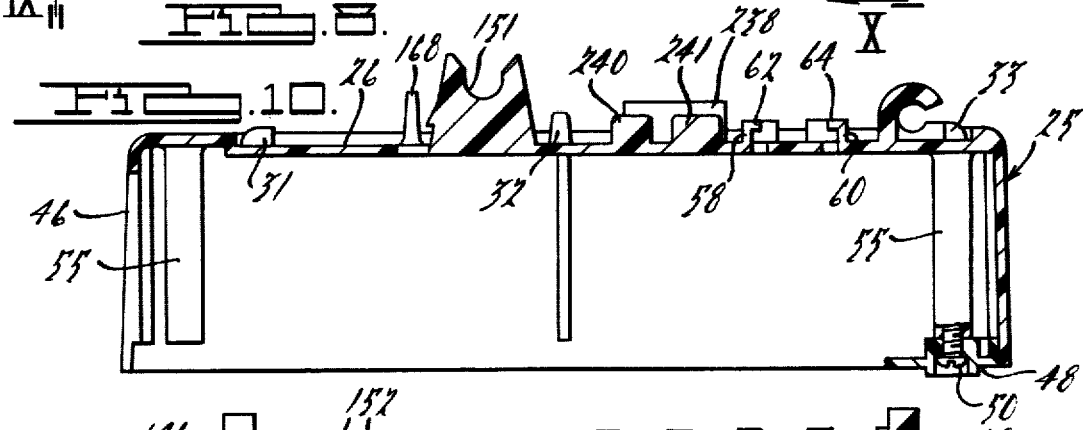
FIG. 10 is a cross section taken substantially on the line X—X in FIG. 8 and looking in the direction of the arrows.
Figure 9:
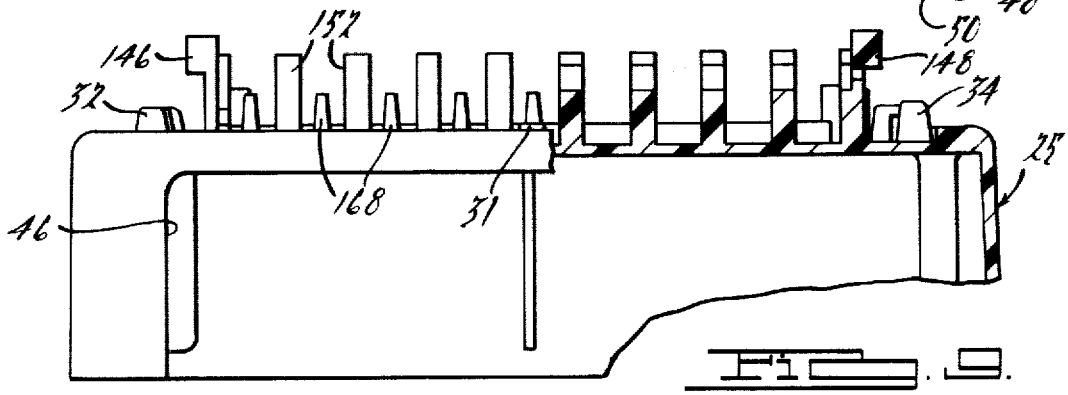
FIG. 9 is a view partly in vertical section and partly in front elevation taken substantially on the line IX—IX in FIG. 8 and looking in the direction of the arrows.
Figure 14:
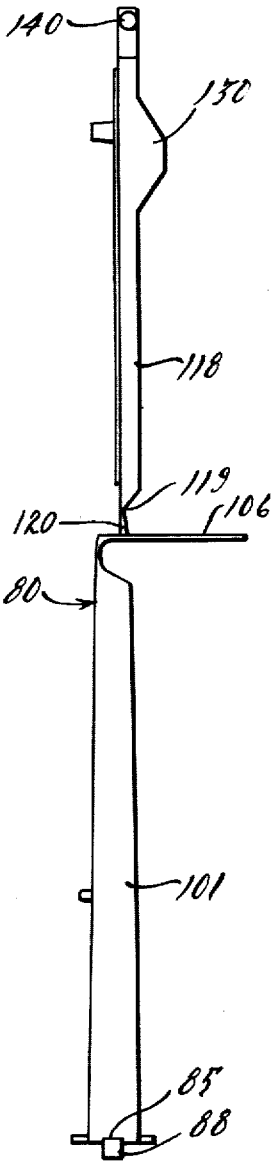
FIG. 14 is a side view thereof taken as indicated by the arrow XIV in FIG. 13.
Figure 13:
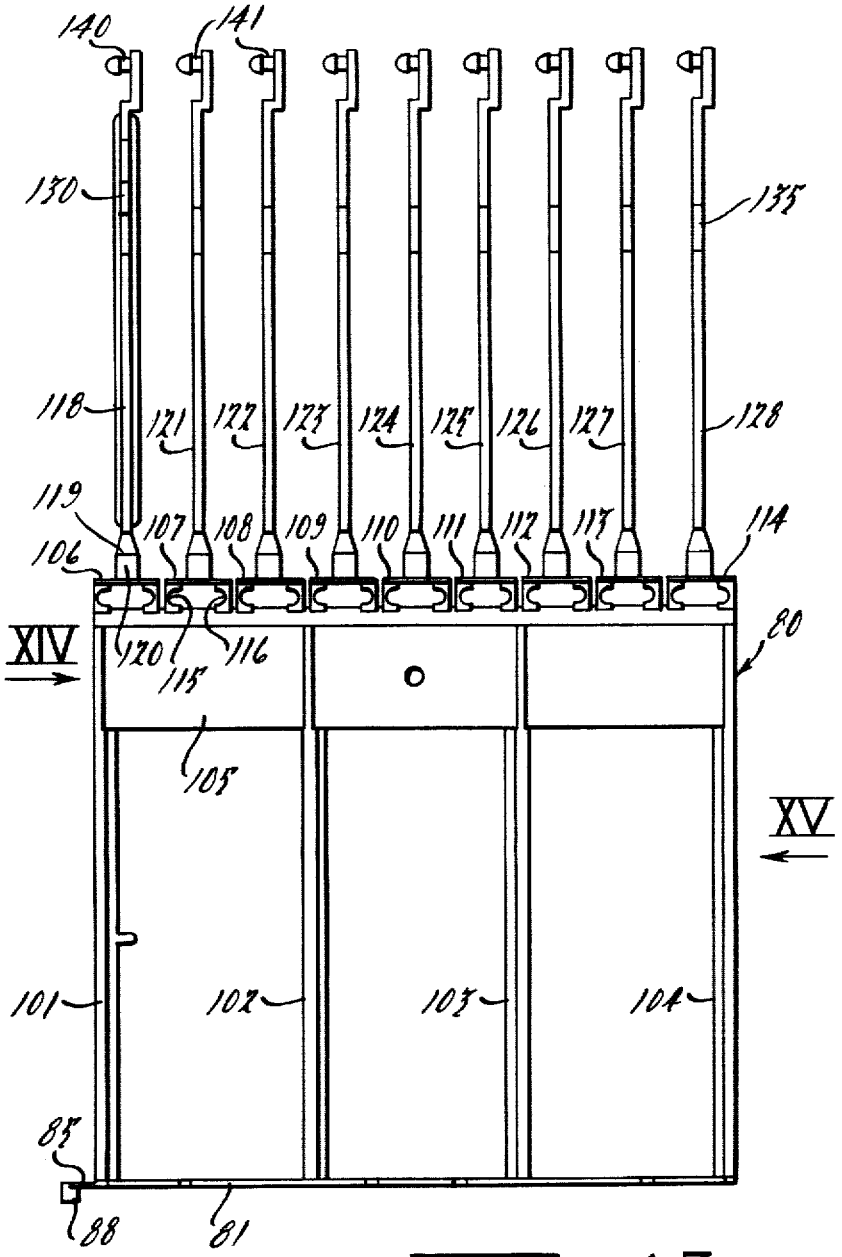
FIG. 13 is a plan view of the integral target-lift rod-target frame structure with the parts positioned as molded.

Molded integrally with the panel area 26 at a position below the target viewing compartment area 43 are two transversely extending parallel rib-like walls 58, 60, from the tops of which are three pair of short inturned integral holding flanges, one pair, 62, 64 near the right end, a second pair, 66, 68 near the center, and a third pair 70, 72 at the left end. As best shown in FIG. 8, the walls 58, 60 do not extend the full width of the depressed panel area 26. All of the holding flange portions are relatively short longitudinally. The space between the walls 58, 60 below the holding flanges constitutes a slideway adapted to snugly receive and retain the flat base portion 81 of an integral target/frame/push rod/-target structure generally designated 80.

Figure 16:
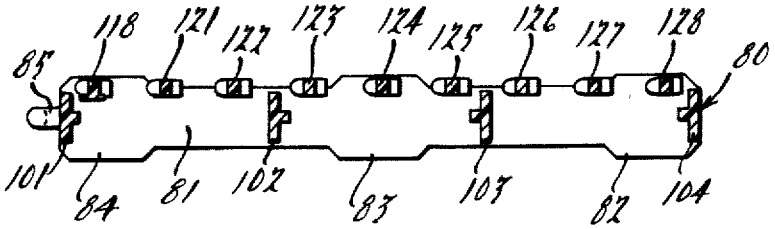
FIG. 16 is a sectional plan view taken substantially on the line XVI—XVI in FIG. 15, looking in the direction of the arrows.
Figure 21:
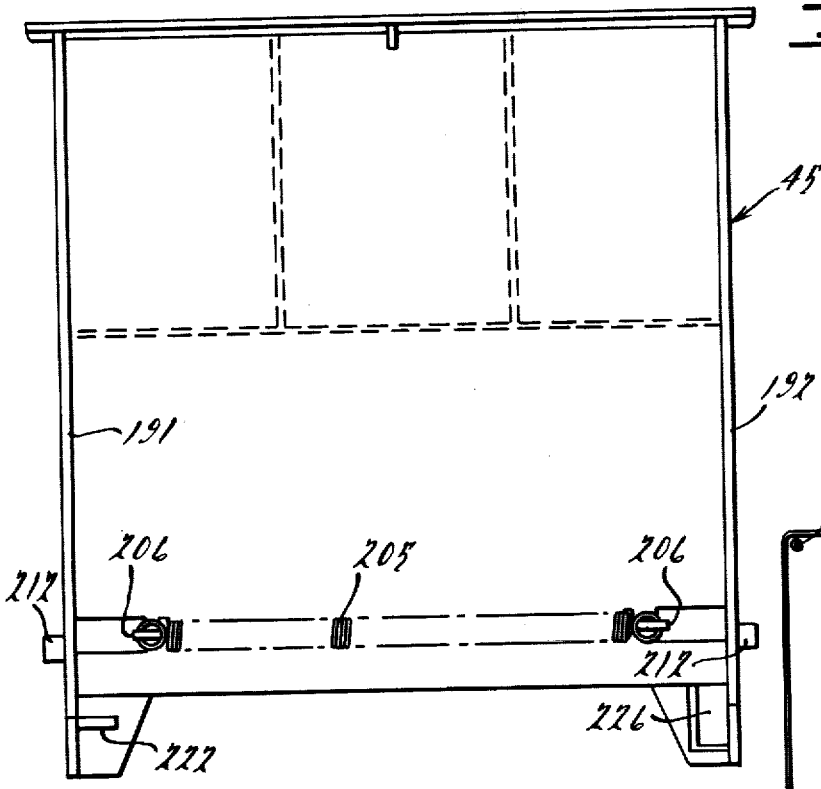
FIG. 21 is a bottom plan view of a cash drawer.
Figure 20:
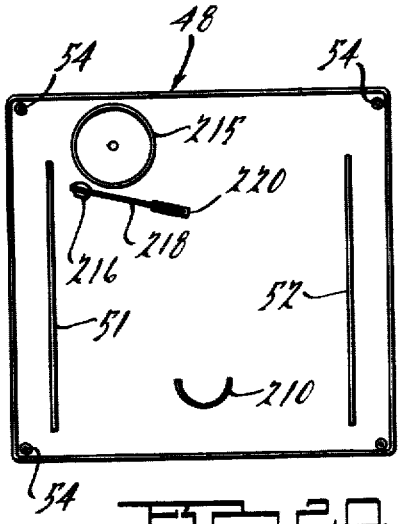
FIG. 20 is a top plan view of the base plate and attached parts, on a smaller scale.
Figure 22:
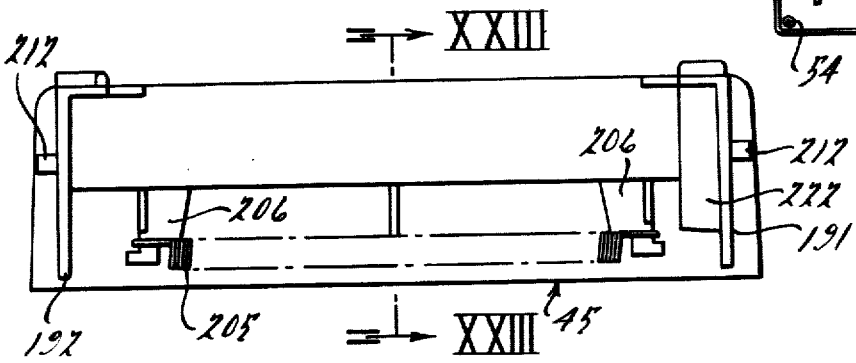
FIG. 22 is a rear elevational view of the cash drawer.
Figure 23:
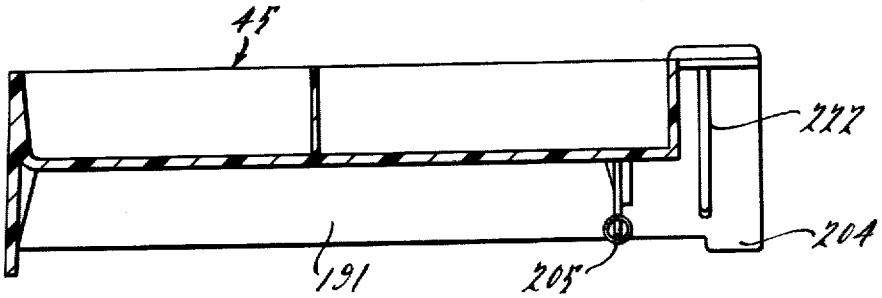
FIG. 23 is a longitudinal vertical sectional view of the cash drawer.

The structure 80 is integrally molded of one of the well-known plastics of a type which is relatively rigid in thick sections but which in thin sections is flexible, resilient and resistant to fatigue failure, such as a suitable polypropylene, so that extremely thin sections are adapted to function as long-lived hinging portions. As best shown in FIG. 16 the flat base portion 81 of structure 80 is narrower than the distance between the opposed holding flanges 62, 64, 66, 68 and 70, 72, except in three widened areas 82, 83, 84 which are spaced conformably to the longitudinal spacing of the three pairs of holding flanges. The widened portions 82, 83, 84 are of a width to fit between the walls 58, 60 and to underlie the holding flanges but are of a length shorter than the longitudinal spacing between such holding flanges, so that the structure 80 can be installed by placing its base 81 on top of panel area 26 with the widened portion 84 on top of the panel area in the area 91 between the left hand pair of flanges 70, 72 and the middle pair 66, 68, the widened portion 83 in the area 92 between the middle pair 66, 68 and the right hand pair 62, 64, and the widened portion 82 on the panel portion 26 to the right of the right hand pair 62, 64. The base portion 81 is then moved to the left as viewed in FIG. 8 until the portion 84 is arrested by inturned end flange portions 94, 95 of the walls 58, 60, at which time the widened portions are under and held by the retaining flanges. A lug 88 extending downwardly from a flexible arm 85 at the left end of base portion 84 of the structure 80 snaps into a hole 87 in the panel area of base 25 at such time to lock the structure 80 in position.

Four integral columns 101, 102, 103, 104 extend upwardly from base portion 81 and carry at their tops an integral transverse stiffening panel portion 105 and also a plurality of vertically swingable individual flat targets 106–114 inclusive. The targets are connected to the upper edge of stiffening panel portion 105 by integral thin coaxial hinging portions as 115, 116. A pushrod is connected to each target to actuate it between a raised visible position and a lowered concealed position (FIG. 3). One of the integral pushrods is articulated to the back of each target, at a position spaced from the hinge axis, by means of a short stiff arm portion 120 molded as a rigid unit with the target and to the outer end of which the pushrod is connected by an integral hinging portion as 119. The arms 120 are connected to their respective targets at a position spaced from the axis of the hinging portions 115, 116 and project perpendicularly from the backs of the targets. The pushrod 118 for the left hand target 106 is relatively stiff. In the operative positioning of the parts, rod 118 and the other pushrods, 121–128 inclusive, extend downwardly from the arms 120, 121 of their respective targets 106–114.

Pushrod 118 carries on its rear surface a cam 130 for actuating a target latch plate 133, while each of the pushrods 121–128 carries on its rear surface a wedge-shaped cam-type keeper lug or abutment 135 having a rear surface which inclines outwardly and downwardly therefrom and terminates in a horizontal bottom abutment surface located at a height such that when one of the pushrods 121–128 is moved upwardly to raise its target to a vertical position which renders it observable through the window 42, the horizontal bottom surface on the lug 135 on the arm is adapted to overlie the inturned top flange 134 of target latch plate 133, to hold the rod and the target in elevated position.

At its lower end each of the pushrods 118 and 121–128 is provided with a short transverse interlockable hinge pin portion 140, 141, adapted to snap into a comformably apertured rear end portion of one of the individual key levers as 142, 143 and thereby provide a pivoted connection thereto. The key levers are fulcrumed on a hinge rod 145 supported at its ends in upstanding lugs 146, 148 integral with the panel area of base 25. Each key lever also has at its fulcrum axis a hub as 149. The hubs rest and are rotatable in arcuate saddle bearings areas 150, 151, provided in the upper portions of the support lugs 146, 148 and also in the tops of each of a series of intermediate support lugs 152, one of the lugs 152 being positioned between each pair of adjacent key levers and underlying the hub portions to provide a rigid bearing support when the key levers are depressed.

Each of the key levers 142, 143 has an actuating arm 162, 163 extending upwardly and outwardly through a suitably positioned slot as 155, 156 in the keyboard section 37 of the upper housing 30, and carries at its end a suitable frictionally attached finger button 158. On the front of each of the actuating arms 162 and 163 is an abutment, designated 164 in the case of actuating arm 142, and 165 in the case of arm 143. The abutments 164 and 165 are individually engageable with the corresponding teeth 166 of a comb-type spring 170. The teeth of the comb spring are stressed to bear upwardly and rearwardly against the actuating arms 162, 163, urging the actuating arms and key levers upwardly and rearwardly and yieldably urging the finger buttons to aligned relationship and the targets to the lowered horizontal position. The comb spring is trapped at its lower end between the bottoms of the lug members 146, 148, 151 and a series of post-like locating abutments 168 also integrally upstanding from panel area 26 and, as best shown in FIG. 3, so positioned and of such height that the key lever abutments 164, 165 normally urge the teeth of the comb spring forwardly and downwardly with a slight initial bias, while when a key is depressed, the spring finger engaged thereby is flexed farther forwardly, as indicated at 166*a* in FIG. 3, the spring leaf so designated being shown as depressed.

Depression of one of the levers 142 or 143, shown in FIG. 3 as one of the levers 143, lifts the pushrod connected thereto, raising its target to the visible position in which target 113 is shown in that view. As the pushrod connected to any of the key levers 142 or 143 rises, the keeper abutment 135 thereon tends to cam the latch plate 133 towards the rear and at the same time tends to flex the pushrod in the opposite direction (forwardly) and to a bowed shape. The keeper abutment then passes above the top flange 134 of the latch plate, and when the pressure is removed from the finger button, the horizontal bottom surface of the keeper abutment overengages and bears down on latch plate flange 134 and holds the target elevated.

The pushrods 121–128 inclusive, are sufficiently flexible so that when one target is already raised, and one or more additional levers are actuated, the second and subsequent pushrods so actuated, bow forwardly sufficiently to permit their keep lugs 135 to pass above the flange 134 without camming the latch plate rearwardly and releasing the previously elevated target or targets, so that all such targets will remain elevated until the target release lever 142A is depressed. It will be noted that the top flange 134 of the latch plate 133 is not horizontal but inclines upwardly towards the front. Thus when one of the targets (other than target 106) is elevated, its keeper abutment 135, after the finger is released from the button, bears downwardly against the top of the flange 134 of arm 133 under the downward force derived from the stressed comb spring 170. Such downward pressure of abutment 135 exerts a force in the nature of a rocking couple on the latch plate 133 and which has a component in the forward direction, that is, counterclockwise as viewed in FIG. 3. This augments the holding force derived from spring 170 and insures that the latch plate is held firmly enough so it will not be cammed to the released position by the keeper lugs of targets which are subsequently raised. It will be seen that this action is achieved by making the pushrod portions 121-128 sufficiently flexible and resilient to be temporarily bowed forwardly sufficiently, but within their elastic limit, to allow the keeper abutments 135 to clear the flange 134.

Figure 6:
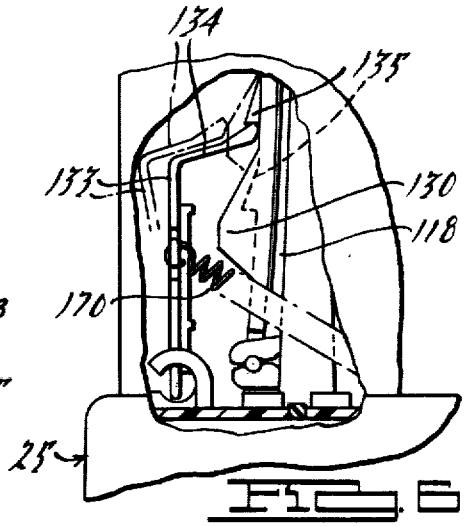
FIG. 6 is a fragmentary side elevational view looking as from the left of FIG. 2, with the case partially broken away and showing the target latching mechanism.
Figure 4:
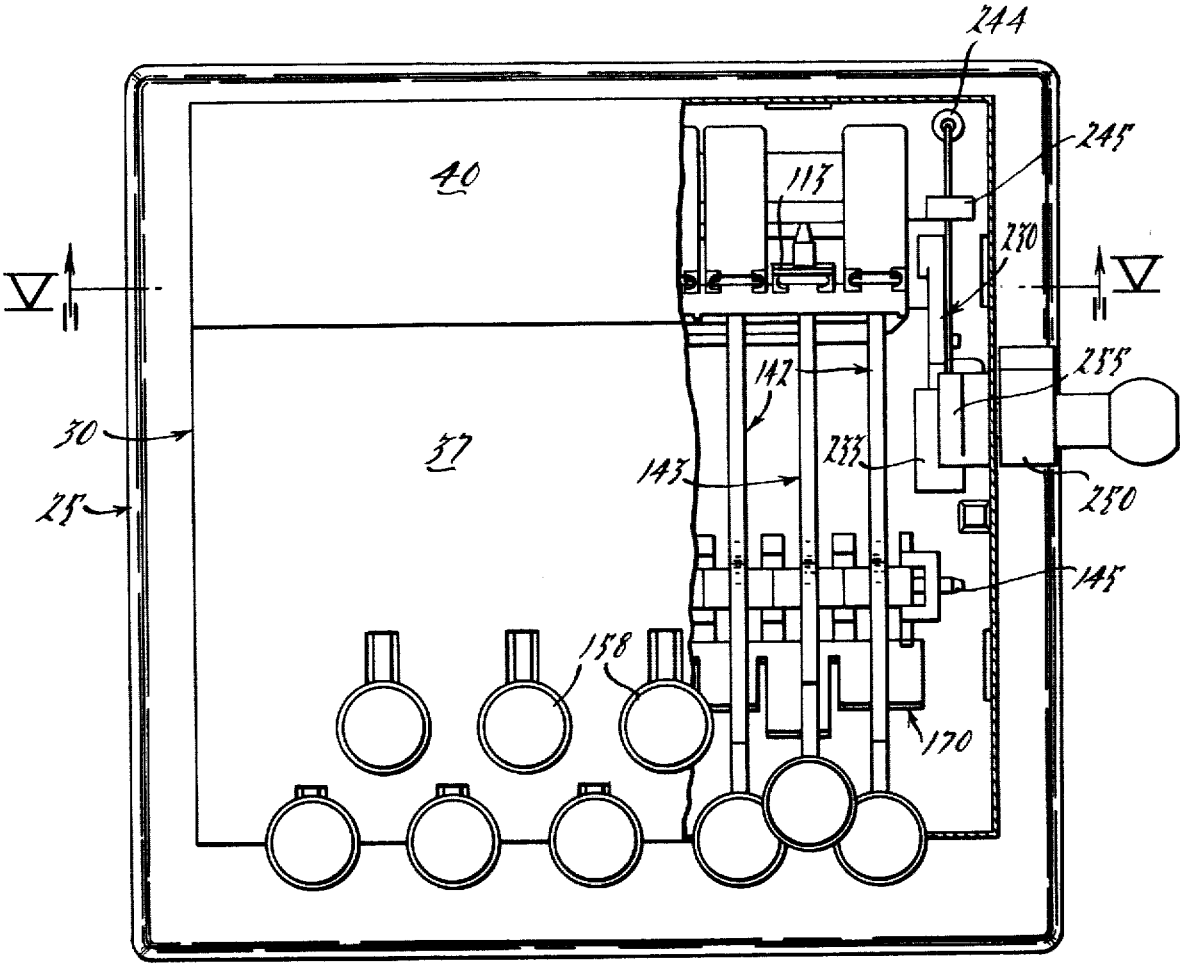
FIG. 4 is a top plan view, partly broken away.
Figure 11:
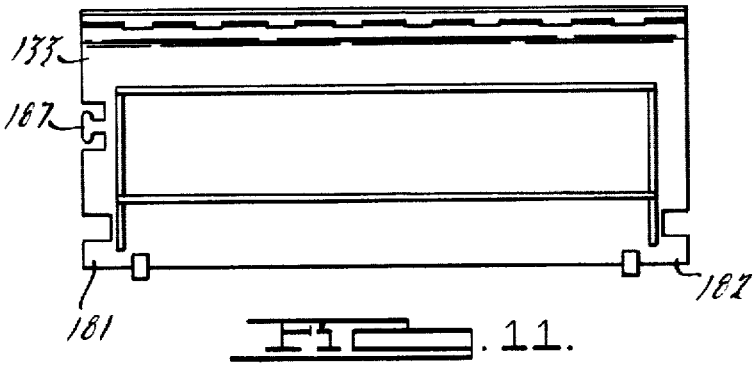
FIG. 11 is a front elevational view of the target latch.
Figure 12:
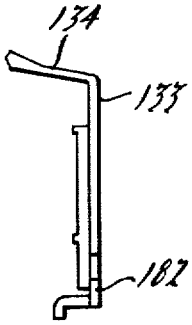
FIG. 12 is a side elevational view of the target latch.
Figure 5:
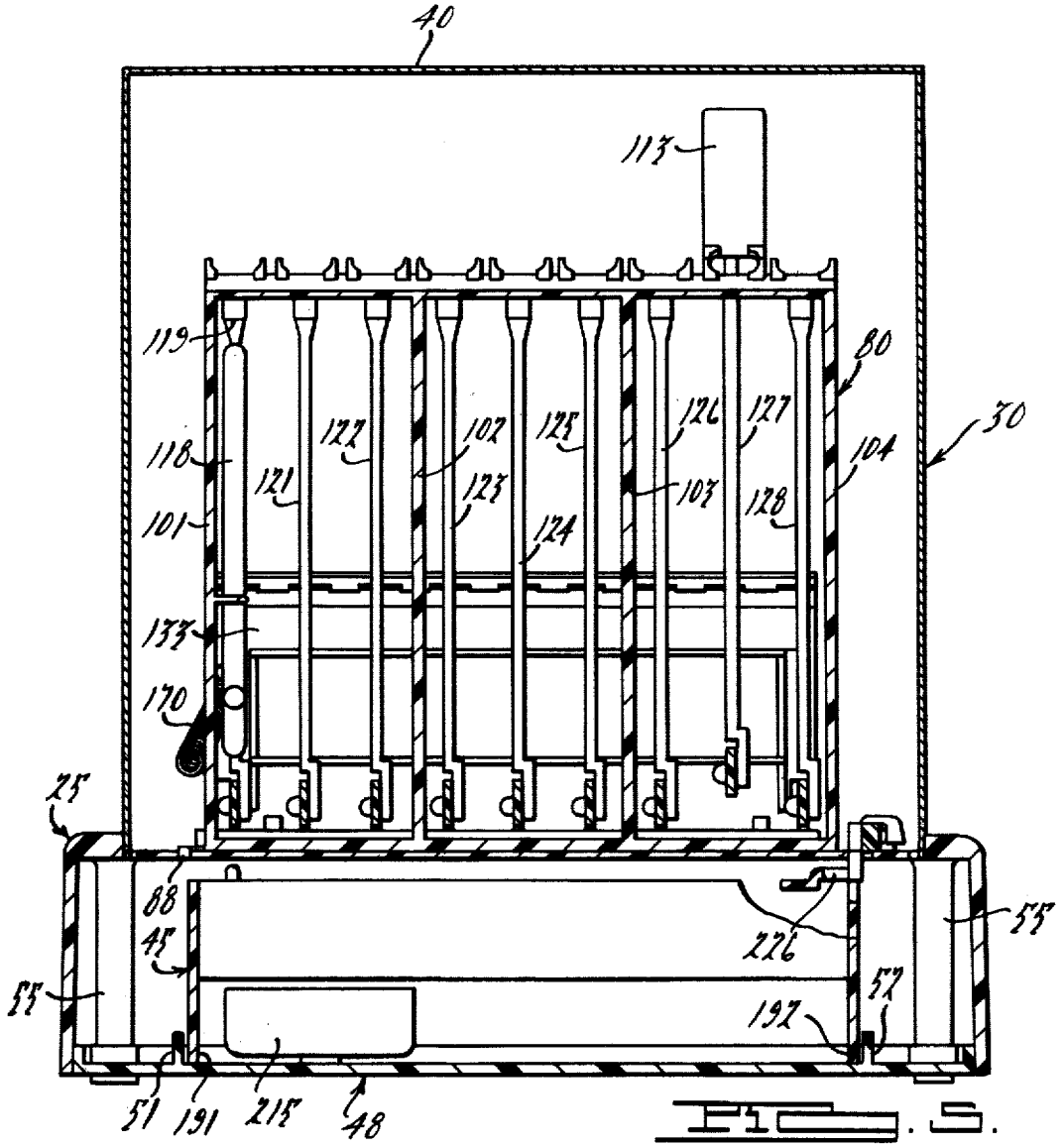
FIG. 5 is a cross section taken substantially on the line V—V in FIG. 4 and looking in the direction of the arrows.
Figure 17:
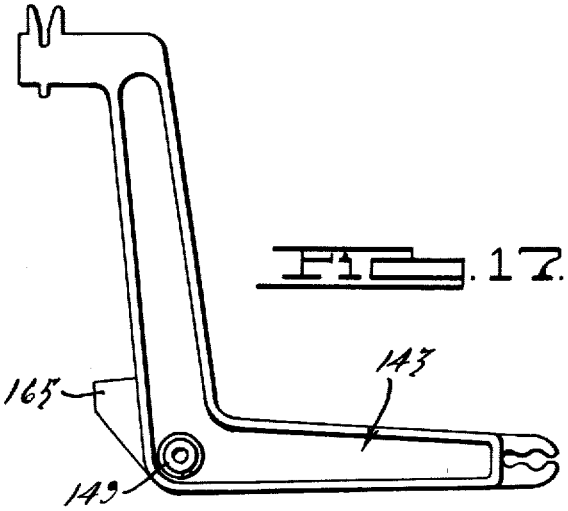
FIG. 17 is a side elevational view of a key lever.
Figure 18:
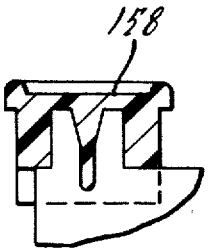
FIG. 18 is a sectional detail of the outer end portion of the actuating arm of a key lever showing an attached finger button.

Pushrod portion 118 is stiffer than pushrod portions 121-128, and carries an enlarged cam 130 which slopes both at its top and bottom, as shown in FIG. 6. Pushrod 118 is connected to a release lever 142A similar to target levers 142 and is stiff enough so that when the lever 142A is depressed, the cam 130 releases the latched targets, permitting them to drop, by camming the latch plate rearwardly from beneath the keeper abutments 135 of the raised target or targets. The targets and their connected pushrod portions 118, 121-128 are positively moved downwardly by the leaf-spring 170.

As shown in FIGS. 3, 6, 7 and 11, the lower outer corners of the latch plate are formed with integral trunnion bearing stubs 181, 182 which project into bearing openings defined by arcuate integral bearing lug portions 184 formed on the top of panel area 26 of the base 25 and open at the rear as indicated at 185 to permit insertion of the latch plate which, when installed, does not during operation swing rearwardly far enough to disengage at the opening 185. The helical tension latch plate spring 170 is engaged at its opposite ends over a retainer knob 187 on the left end of the latch plate and a retaining hook 188 molded integrally with the base.

As best shown in FIG. 3, the drawer 45 has side walls 191, 192 which are deeper than the usable portion of the drawer, the usable portion being defined by the space within the drawer above a horizontal partition 193. The drawer is also molded of plastic as an integral unit. At their rear ends the side walls 191, 192 have integral downwardly projecting bearing lug portions 204, slidable on top of the base plate 48. A forward slidable support for the drawer is provided by the upturned peripheral flange portion 49 of the base plate. A helical tension spring 205 is stretched between and retained by lugs 206 laterally spaced on the bottom of and near the rear of the drawer. A mid-portion of the spring extends across the front of a partly cylindrical upstanding abutment 210 carried by the base plate 48, so that when the drawer is pushed in to the closed position, as shown in FIG. 3, the spring is stressed between abutment 210 and the lugs 206 and tends to project the drawer. Outward movement of the drawer is limited by integral lugs 212 projecting from the side walls 191,192 near the rear of the drawer and engageable with the inturned front wall portions of the base on either side of the front opening 46.

On top of the base plate 48 near the left rear corner a bell 215 is located by means of a central rivet and is adapted to be struck by a clapper consisting of a metal button 216 carried by a leaf spring 218 supported in a slotted lug 220 on the base plate. A flange 222 on the bottom of the drawer near the back is positioned to wipingly pass over the end of the clapper spring 218 as the drawer is opened and closed, so that upon opening the drawer, flange 222 pulls the spring 218 forwardly until flange 222 snaps free, releasing the spring to drive the clapper against the bell. When the drawer is pushed inwardly, flange 222 snaps over the end of the clapper and passes behind it to recock the spring actuating arrangement.

When the drawer is fully closed, a latch tooth 225 projects into an opening 226 in the rear right corner of the upper portion of the drawer to hold the drawer closed. Tooth 225 is an integral downwardly projecting extension of an arm of a drawer release lever 230. Lever 230 is a bellcrank having a horizontal arm 231 carrying tooth 225 and which normally lies flat against panel area 26. Tooth 225 projects downwardly through an opening 227 in the base. The forward side of the tooth 225 is inclined so that as the drawer is closed, the bellcrank is cammed counterclockwise (FIG. 7) to permit the drawer to move to the fully closed position whereat the tooth snaps into the hole 226. An upstanding generally vertical arm 232 of the bellcrank has at its top an inclined cam follower pad 233. The mid-positioned fulcrum portion of the bellcrank is defined by trunnion bearing stubs as 234 projecting from the opposite sides of the fulcrum area. One of such stubs projects into a bearing hole 239 in a lug 238 on the base and the other extends between a pair of spaced lugs 240, 241 on the base. The bellcrank is urged clockwise, as viewed in FIG. 7, to yieldably maintain the tooth 225 in the lowered, latching position, by a spring wire 243 which has its rear end turned downwardly into a locating hole in a boss 244 on the panel area of the base and which extends forwardly under a hook 245, also integral with the panel area, and over an abutment hook 246 on the horizontal arm of the bellcrank. The bellcrank is actuated by means of a crank handle 250 journaled in the right side wall 252 of the upper housing 30 and carrying inside the housing a cam 255 which, when the crank is rotated, is engageable with the pad 233 to rock the bellcrank, raise the tooth 225 and release the drawer for projection by the spring 205.

This Detailed Description of the preferred embodiment, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While a preferred embodiment of the invention has been described herein, it will be appreciated that various modifications and changes may be made without departing from the spirit and scope of the appended claims.

What is claimed is:

1. In a cash register mechanism, in combination with a supporting and housing structure including a windowed viewing area, a plurality of targets actuatable to and from observable positions with respect to the viewing area, and means including a plurality of pushrods, one of which is operatively connected to each target and movable longitudinally to actuate the target to and from observable position, characterized by a medial area incorporated in each pushrod which area is resiliently flexible laterally of its length, said pushrods being relatively stiff longitudinally and being biased longitudinally in one direction to actuate the targets away from observable position and movable longitudinally in the opposite direction to actuate the targets to observable position, a latch member movable laterally of the pushrods to and from a latching position in which it engages said medial areas of the pushrods, a cam-type latching keeper abutment on each pushrod in said medial area thereof and projecting toward and engageable with the latch member and tending to cam the latch member away from the pushrod and also tending to bow the pushrod in the opposite direction when the pushrod is longitudinally actuated in such opposite direction, means biasing the latch member toward the pushrods and to a latching position with a force exceeding the force required to bow said medial area of a pushrod through a distance equal to the cam lift of the keeper abutment, whereby the camming effect of the keeper abutment during movement of a pushrod in such opposite direction bows the medial portion of the pushrod away from the latch member without moving the latch member away from said latching position, the lift developed by the cam action of said keeper abutments being insufficient to bow the pushrods beyond their elastic limit, and the keeper abutments having abutment surfaces which overengage the latch member to establish a latched condition when the bowed pushrods straighten after completion of the camming action which occurs during such movement thereof in said opposite direction.

2. A cash register mechanism as defined in claim 1 wherein the overengagement of the latch member by the keeper abutments opposes movement of the latch member away from the pushrods.

3. Means as defined in claim 2 wherein the reaction of the abutments on the latch member in the latched position exerts a rocking couple on the latch member having a component of force urging the latch member toward the pushrods.

4. In a cash register mechanism, in combination with a base member, a plurality of key levers rockably mounted on the base member, an integral combined target, target actuating and target latching structure connected to and actuatable by the key levers, said structure comprising an upstanding support on the base, a plurality of targets integral with and hinged to an upper portion of said support, a pushrod integral with and extending downwardly from and articulated to each of said targets, and means operatively connecting a lower end portion of each of said pushrods to one of said key levers for longitudinal actuation thereby.

5. Means as defined in claim 4 wherein said key levers extend from one side of said support through and beyond said support for connection to said pushrods.

6. Means as defined in claim 4 wherein each pushrod is articulated to a corresponding target by means of a short rigid arm portion integral with and projecting from the target at a position spaced from the hinge axis of the target, said arm portion being hingedly connected to the pushrod.

7. Means as defined in claim 4 wherein each pushrod has an intermediate portion flexible to a bowed shape, and latching means for holding said pushrods in an actuated position, said latching means comprising a latch member movable laterally toward and away from said intermediate portions of the pushrods, means biasing the latch member toward the pushrods, a cam-type latching keeper abutment on said intermediate portion of each pushrod and projecting therefrom toward and engageable with the latch member and tending to cam the latch member away from the pushrod and to bow the pushrod in the opposite direction when the pushrod is longitudinally actuated, the lift developed by the cam action of said abutments being insufficient to bow the pushrods beyond their elastic limit.

8. Means as defined in claim 7 including means yieldably opposing movement of the latch member away from the pushrods with a force greater than that required to bow the pushrods to an extent exceeding the cam lift of said cam-type abutments.

9. In a cash register mechanism, in combination with a base, a plurality of key levers rockably supported by the base, a housing portion supported by the base and having a front keyboard area and having a windowed viewing compartment in an upper rear area thereof, means accessible at the keyboard area for actuating the key levers, a plurality of targets supported in the housing portion for actuation about a hinge axis from a generally horizontal lowered position below the windowed area of the viewing compartment to a generally vertical raised position in the windowed area, means for so actuating said targets, comprising a plurality of pushrods, one articulated to each key lever and extending upwardly therefrom, a plurality of rigid arms, each of which is rigidly connected at its inner end to one of said targets, each arm extending substantially perpendicularly from the target, and each pushrod being hingedly connected at its upper end to the outer end of one of said arms.

10. A cash register mechanism as defined in claim 1 wherein the pushrods extend and are longitudinally movable in, a generally vertical direction, the latch member including an upright supporting portion hingedly carried by said supporting and housing structure at a position spaced from the pushrods, further characterized by a latching portion on said latch member extending angularly from said supporting portion toward said medial areas of the pushrods for engagement with said keeper abutments.

11. A cash register mechanism as defined in claim 1 wherein the targets are hingedly supported for swinging movement during actuation thereof, and an arm rigidly connected to and projecting from each target at a position spaced from the hinge axis of the target, each such arm having its end farthest from the target pivotally connected to one of said pushrods.

* * * * *